US006561624B1

(12) United States Patent
Kikugawa et al.

(10) Patent No.: US 6,561,624 B1
(45) Date of Patent: May 13, 2003

(54) METHOD OF PROCESSING NOZZLE PLATE, NOZZLE PLATE, INK JET HEAD AND IMAGE FORMING APPARATUS

(75) Inventors: Shozo Kikugawa, Tokyo (JP); Takemasa Namiki, Tokyo (JP)

(73) Assignee: Konica Corporation, Tokyo (JP)

( * ) Notice: Subject to any disclaimer, the term of this patent is extended or adjusted under 35 U.S.C. 154(b) by 196 days.

(21) Appl. No.: 09/716,066

(22) Filed: Nov. 17, 2000

(30) Foreign Application Priority Data

Nov. 17, 1999 (JP) ..... 11-327105

(51) Int. Cl.[7] ..... B41J 2/14
(52) U.S. Cl. ..... 347/45; 347/46
(58) Field of Search ..... 347/44, 45, 46; 216/27; 156/273.3

(56) References Cited

U.S. PATENT DOCUMENTS 5,759,421 A * 6/1998 Takemoto et al. ..... 216/27
5,812,158 A * 9/1998 Murthy et al. ..... 347/45
5,863,371 A * 1/1999 Takemoto et al. ..... 156/273.3
6,074,040 A * 6/2000 Usui et al. ..... 347/45
6,130,687 A * 10/2000 Bruil et al. ..... 347/45

FOREIGN PATENT DOCUMENTS

| | | |
|---|---|---|
| JP | 48-37030 | 5/1973 |
| JP | 57-107848 | 7/1982 |
| JP | 64-87359 | 3/1989 |
| JP | 7-125220 | 5/1995 |
| JP | 10-157106 | 6/1998 |

* cited by examiner

*Primary Examiner*—Anh T. N. Vo
(74) *Attorney, Agent, or Firm*—Frishauf, Holtz, Goodman & Chick, P.C.

(57) ABSTRACT

A method of processing a nozzel plate on which a plurality of nozzel holes for jetting ink are provided, comprises steps of: bringing one side of the nozzele plate in contact with a processing liquid; bringing the other side of the nozzel plate in contact with a gas phase; and forming a boundry surface between the processing liquid and the gas phase so that a film layer is formed on the one side of the nozzel plate by the processing liquid.

23 Claims, 8 Drawing Sheets

METHOD OF PROCESSING NOZZLE PLATE, NOZZLE PLATE, INK JET HEAD AND IMAGE FORMING APPARATUS

BACKGROUND OF THE INVENTION

This invention relates to a method of processing a nozzle plate, a method of manufacturing a nozzle plate, a nozzle plate, an ink jet head, and image forming apparatus.

In an ink jet printer, the ink chamber of the ink jet head is filled with ink and it is jetted from a nozzle by the application of pressure to the ink chamber. After jetting, the ink meniscus, the surface of the ink, is withdrawn into the nozzle. After that, the ink chamber is refilled with ink from the ink tank, to be ready for the next jetting of ink.

However, because the pressure, which is applied for jetting ink, remains and fluctuates after the jetting of ink owing to the delay of the ink following the pressure applied, the ink meniscus vibrates. Owing to the remaining pressure fluctuation, sometimes the ink in the nozzle overflows the outlet for jetting to the outside. The ink, which has overflowed onto the surface of the nozzle plate, is next withdrawn into the nozzle by being brought into negative pressure, but the surface of the nozzle plate is smudged by the ink which has overflowed. If the ink droplet which is jetted next comes in contact with this smudge, the direction of jetting is deviated, or jetting is often made impossible; thus, the smudge of the nozzle plate makes one of big causes of the deterioration of image quality.

In order to prevent the smudge of the nozzle plate with ink, it has been put into practice that an ink-repellent processing is applied to the surface of the nozzle plate. If the surface of the nozzle plate is subjected to an ink-repellent processing, when ink meniscus comes outside the jetting outlet, it can be prevented that the ink overflows onto the surface of the nozzle plate, or spreads out by wetting the surface.

On top of the nozzle plate, if the inside of the nozzle hole is processed for repelling ink, the nozzle plate is made more scarcely to be smudged and jetting is stabilized. Because the ink meniscus is formed at the border of the portion subjected to the processing for repelling ink and the portion not subjected to the ink-repellent processing, if this border is located at a position retracting into the nozzle hole for a certain length, jetting is stabilized and the flying direction of the ink droplet is also stabilized. Further, even though the meniscus vibrates, the surface of the nozzle plate is hardly smudged, because ink is difficult to come out onto the surface of the nozzle plate.

If the entering length of the portion processed for repelling ink is too long, the resistance for jetting ink becomes large, to reduce the amount of ink jetting. Further, an air bubble is easy to be sucked into the ink chamber. On the contrary, if the entering length is too short, the surface of the nozzle plate is easy to be smudged, and the direction of the ink droplet is easy to deviate, to cause the jet-stabilizing effect to be lost. Because there are several tens to several hundreds of nozzle holes in one nozzle plate, it is especially important to apply the ink-repellent processing to the outlet portion of every nozzle hole for a constant length and uniformly. If the length of the processed portion varies from one nozzle to another nozzle, the amount of jetted ink droplet and the flying direction also vary from one to another, to reduce image quality to a large extent.

Further, on the other hand, at the ink inlet side in the nozzle hole, a film having familiarity for ink (hereinafter a coined word "ink-familiar" will be used for the phrase "having familiarity for ink") is formed in order that ink may flow smoothly into the nozzle. It is desired that the portion of this ink-familiar film also enters into every nozzle uniformly, because it influences the amount of ink droplet to be jetted and the flying direction.

It is noted in the publications of the unexamined patent applications S48-37030 and S57-107848 etc. that the surface of the nozzle plate and the inside of the nozzle holes for a certain depth are coated with an ink-repellent material by sputtering after the nozzle holes have been formed in the nozzle plate. However, it is very difficult to apply by sputtering an ink-repellent processing to the portion near the outlet inside the nozzle holes for a constant length.

In the publication of the unexamined patent application S64-87359, it is noted that the nozzle holes are filled with a natural wax and the wax attached to the end surface of the holes is wiped off, then the surface of the nozzle plate and an ink-repellent film is formed at the portion near the jetting outlet of the nozzle holes by coating with tetrafluoroethylene using the plasma polymerization method, and after that, the wax is solved and removed.

In the publication of the unexamined patent application H10-157106, it is noted that an ink-familiar film is provided at the ink inlet side by electrodeposition coating with the ink outlet side of the nozzle plate protected by a protective sheet, then the protective sheet is removed and an ink-repellent film is provided at the ink outlet side of the nozzles by electrodeposition coating.

In the publication of the unexamined patent application H7-125220, it is noted that a resin film is laminated and inserted from the rear side of the nozzle plate made of a stainless steel, and the surface of the nozzle plate and the outlet portion of the nozzle holes are processed for repelling ink, to make the ink-repellent processing get into the inside of the nozzle holes for a certain length from the surface, without being limited to the surface.

In any one of the former examples, the ink-repellent processing is carried out after the formation of the holes. At that time, if the inside of the nozzle holes and the rear surface is subjected to the ink-repellent processing, air bubbles stagnate there, or the nozzle plate can not be bonded to the main body. For that reason, it has been put into practice that first the rear surface and the inside of the nozzle holes are masked, then an ink-repellent processing is carried out, and the masking material is removed. For example, as the representative method of masking, a method as described in the publication of the unexamined patent application S64-87359 such that the nozzle holes are filled with a resin material and the rear surface of the nozzle plate is covered with the resin material, and a method as described in the publication of the unexamined patent application H10-157106 such that the rear surface of the nozzle plate is laminated with a resin film can be cited; many are methods such that the resin material overflowing onto the front surface is removed and an ink-repellent processing is applied only to the front surface.

However, it is difficult to control the method in which the nozzle holes are filled with a resin material with a high precision to determine the entering length of the portion subjected to the ink-repellent processing, its cost comes to a high value, and mass production can not be expected. Further, it is difficult to remove the resin material from the nozzle holes completely after processing. Because the processing is troublesome, the fluctuation of the length among the nozzles is large, and the jet stabilization of ink droplets is sometimes made worse on the contrary.

Generally speaking, several tens to several hundreds of nozzles having a hole diameter of 20 to 60 μm are formed in the nozzle plate, therefore, it is extremely difficult to fill each of the nozzles with a photosensitive resin material uniformly with a precision in the order of μm. If the entering length of the ink-repellent film have a fluctuation among the nozzles, the amount of ink jetted from each of the nozzles varies from one nozzle to another, to make a cause to lower image quality by a great deal. Further, it is also difficult to remove completely the resin material which has been crosslinked after processing from the nozzle holes having a diameter of 20 to 60 μm. If the crosslinked resin material is removed in a severe condition, sometimes the ink-repellent film coated by electrodeposition is peeled off too. These problems occur in the same way in the case where the ink-familiar film is made to get into the nozzle holes for a constant length.

SUMMARY OF THE INVENTION

This invention was made in view of the above-described points, and is a method in which it is controlled with a high precision by using a gas or a liquid the entering length of the film based on a processing liquid formed in the nozzle holes of the nozzle plate; owing to it, it is possible to improve the jet stabilization of ink droplets and image quality in a simple manner. Further, it is an object of the invention to provide a method of processing a nozzle plate, a method of manufacturing a nozzle plate, and a nozzle plate which make easy the control of the entering length, is of low cost, and is able to be applied to mass production.

In order to solve the above-described problems and accomplish the object, this invention has any one of the following structures.

(1) A method of processing a nozzle plate for forming a film (a film layer) based on a processing liquid on said nozzle plate comprising the steps of bringing a processing liquid into contact with said nozzle plate having a plurality of nozzles (nozzle holes) for jetting ink from one side of said nozzle plate, bringing a gas into contact with said nozzle plate from the other side, and forming an interface (a boundary surface) by said processing liquid and said gas.

According to the invention set forth in the structure (1), a processing liquid is brought into contact with the nozzle plate from one side of it, and a gas is brought into contact with it from the other side, to form an interface by the processing liquid and the gas, then a film based on the processing liquid is formed on the nozzle plate; thus, by utilizing the interface between the processing liquid for forming the film and the gas, it becomes possible to control it freely and easily with a high precision, the entering length into the nozzle holes of the film formed on the nozzle plate, and further, by using a gas, the formation of the film and its control can be done with a structure which is simpler than before. In the above, the film means the film which is formed by the precipitation of the substance in the processing liquid.

(2) A method of processing a nozzle plate as set forth in the structure (1), wherein the entering length into the nozzle of the aforesaid film formed is controlled by controlling the position of the aforesaid interface.

According to the invention described in the structure (2), by controlling the position of the interface, the entering length of the film formed into the nozzle can be controlled easily with a simple structure.

(3) A method of processing a nozzle plate as set forth in the structure (1) or (2), wherein the aforesaid position of the interface is controlled by controlling the pressure of the aforesaid gas.

According to the invention described in the structure (3), it becomes possible to control it freely and easily with a higher precision, the entering length into the nozzle holes of the film formed on the nozzle plate by controlling the position of the interface by controlling the pressure of the gas, and it is possible to carry out the formation of the film and its control with a simpler structure.

(4) A method of processing a nozzle plate as set forth in any one of the structures (1) to (3), wherein the aforesaid processing liquid is brought into contact with the aforesaid nozzle plate after the aforesaid gas has been brought into contact with it.

According to the invention described in the structure (4), by bringing the processing liquid into contact with the nozzle plate after the gas is brought into contact with it, the film is easily formed by utilizing the interface between the processing liquid and the gas.

(5) A method of processing a nozzle plate for forming a film based on a processing liquid on said nozzle plate comprising the steps of bringing a processing liquid into contact with said nozzle plate having a plurality of nozzles for jetting ink from one side of said nozzle plate, bringing a liquid which is different from said processing liquid into contact with said nozzle plate from the other side, and forming an interface by said processing liquid and said liquid.

According to the invention described in the structure (5), a processing liquid is brought into contact with the nozzle plate from one side of it, and a liquid which is different from the processing liquid is brought into contact with it from the other side, to form an interface by the processing liquid and the liquid, then a film based on the processing liquid is formed on the nozzle plate; thus, by utilizing the interface between the processing liquid for forming the film.and the liquid, it becomes possible to control it freely and easily with a high precision, the entering length into the nozzle holes of the film formed on the nozzle plate.

(6) A method of processing a nozzle plate as set forth in the structure (5), wherein the entering length into the nozzles of the aforesaid film formed is controlled by controlling the position of the aforesaid interface.

According to the invention described in the structure (6), by controlling the position of the interface, the entering length of the film formed into the nozzles can be controlled easily with a simple structure.

(7) A method of processing a nozzle plate as set forth in the structure (5) or (6), wherein the aforesaid position of the interface is controlled by controlling the pressure of the aforesaid liquid.

According to the invention described in the structure (7), it becomes possible to control it freely and easily with a higher precision, the entering length into the nozzle holes of the film formed on the nozzle plate by controlling the position of the interface by controlling the pressure of the liquid.

(8) A method of processing a nozzle plate as set forth in any one of the structures (5) to (7), wherein the aforesaid processing liquid is brought into contact with the aforesaid nozzle plate after the aforesaid liquid has been brought into contact with it.

According to the invention described in the structure (8), by bringing the processing liquid into contact with the nozzle plate after the liquid is brought into contact with it, the film is easily formed by utilizing the interface between the processing liquid and the liquid.

(9) A method of processing a nozzle plate as set forth in any one of the structures (1) to (8), wherein the aforesaid film formed is an ink-repellent film.

According to the invention described in the structure (9), because the film is an ink-repellent film, the nozzle plate is hardly smudged, and the jetting of ink droplets is stabilized. The ink-repellent film in this invention means a film having a contact angle of 90 degrees or over with the ink. For the material of this ink-repellent film, one including a fluorine-contained resin or a silicone resin is desirable.

(10) A method of processing a nozzle plate as set forth in the structure (9), wherein a processing for making the surface to be ink-familiar is carried out after the formation of the aforesaid ink-repellent film.

According to the invention described in the structure (10), by carrying out the processing for making the surface to be ink-familiar after the formation of the ink-repellent film, ink becomes easy to enter into the nozzle, to stabilize the jetting of ink droplets.

(11) A method of processing a nozzle plate as set forth in the structure (9), wherein a processing for making the surface to be ink-familiar is carried out before the formation of the aforesaid ink-repellent film.

According to the invention described in the structure (11), by carrying out the processing for making the surface to be ink-familiar before the formation of the ink-repellent film, it becomes unnecessary to form an ink-familiar film while ink is easy to enter into the nozzle to stabilize the jetting of ink droplets.

(12) A method of processing a nozzle plate as set forth in any one of the structures (1) to (8), wherein the aforesaid film formed is an ink-familiar film.

According to the invention described in the structure (12), the film formed is an ink-familiar film and ink becomes easy to enter into the nozzles to stabilize the jetting of ink droplets. The ink-familiar film in this invention means a film having a contact angle with the ink smaller than 90 degrees.

(13) A method of processing a nozzle plate as set forth in the structure (12), wherein an ink-repellent film is formed after the formation of the aforesaid ink-familiar film.

According to the invention described in the structure (13), by forming an ink-repellent film after the formation of the ink-familiar film, ink becomes easy to enter into the nozzle to stabilize the jetting of ink droplets, and the surface of the nozzle plate becomes difficult to be smudged.

(14) A method of processing a nozzle plate as set forth in any one of the structures (1) to (13), wherein the position of the aforesaid interface is controlled by tightly closing one side of said nozzle plate.

According to the invention described in the structure (14), because the position of the interface is controlled by tightly closing one side of the nozzle plate, the position of the interface is determined by the inner volume of the nozzle, and if the inner volume of the nozzle is kept constant, the pressure is made to be constant, to make it possible to keep constant the position of the interface for every nozzle.

(15) A method of processing a nozzle plate as set forth in the structure (14), wherein the position of the aforesaid interface is controlled by laminating a film on one side of said nozzle plate to tightly close it.

According to the invention described in the structure (15), because the position of the interface is controlled by laminating a film on one side of the nozzle plate to tightly close it, the position of the interface is determined by the inner volume of the nozzle, and if the inner volume of the nozzle is kept constant, the pressure is made to be constant, to make it possible to keep constant the position of the interface for every nozzle.

(16) A method of processing a nozzle plate as set forth in the structure (14) or (15), wherein the aforesaid tight closing is carried out from the side of ink inflow of the aforesaid nozzle plate.

According to the invention described in the structure (16), by carrying out the tight closing from the side of ink inflow of the nozzle plate, it is possible to form the film from the jetting side of ink droplets.

(17) A method of processing a nozzle plate as set forth in any one of the structures (1) to (16), wherein the aforesaid film is formed by electrodeposition.

According to the invention described in the structure (17), by electordeposition processing, a film of 1 to several $\mu$m can be formed easily, uniformly, and firmly on a electrically conductive substrate.

(18) A method of processing a nozzle plate as set forth in any one of the structures (1) to (16), wherein the aforesaid film is formed by plating processing.

According to the invention described in the structure (18), the film can be formed easily, uniformly, and firmly by plating processing.

(19) A method of processing a nozzle plate as set forth in any one of the structures (1) to (18), wherein the aforesaid nozzle plate is made of a metal.

According to the invention described in the structure (19), because the nozzle plate is made of a metal, a filmed ink jet head can be simply and easily manufactured.

(20) A method of processing a nozzle plate as set forth in any one of the structures (1) to (18), wherein the aforesaid nozzle plate is made of a resin.

According to the invention described in the structure (20), because the nozzle plate is made of a resin, a filmed ink jet head can be simply and easily manufactured.

(21) A method of processing a nozzle plate as set forth in the structure (20), wherein the aforesaid nozzle plate has a metallic film on its surface.

According to the invention described in the structure (21), because the nozzle plate has a metallic film on its surface, filming can be easily done by using electrodeposition coating or electroplating.

(22) A method of processing a nozzle plate as set forth in the structure (9), wherein the entering length of the aforesaid ink-repellent film into the nozzle is from 5 $\mu$m to 10 $\mu$m.

According to the invention described in the structure (22), the entering length of the ink-repellent film into the nozzle is from 5 $\mu$m to 10 $\mu$m; therefore, by making it 5 $\mu$m or over, the jet stabilizing effect becomes larger, and the fluctuation of the jetting direction of ink droplets is reduced. Further, by making it 10 $\mu$m or under, it can be suppressed for the jetting resistance to become large, and the amount of droplet fired is more stabilized. Besides, when the meniscus vibrates, the overflow of the ink onto the surface of the nozzle plate and the sucking-in of bubbles into the ink chamber can be more reduced.

(23) A method of processing a nozzle plate as set forth in the structure (9), wherein the fluctuation of the entering length of the aforesaid ink-repellent film into the nozzle is 1.0 μm or under.

According to the invention described in the structure (23), because the fluctuation of the entering length of the aforesaid ink-repellent film into the nozzles is 1.0 μm or under, the amount of droplet fired is more stabilized. In this specification, the fluctuation of the entering length is expressed by the deviation, which is the difference between the entering length in each of the nozzles and the average of the values of the entering length over all the nozzles of the nozzle plate. Further, "the fluctuation of the entering length is 1.0 μm or under" means the state such that the deviation of the entering length in at least 95% of all the nozzles is 1.0 μm or under.

(24) A method of manufacturing a nozzle plate comprising the steps of boring a plurality of nozzles for jetting ink in a plate, carrying out a processing for making ink-familiar the plate provided with said nozzles, forming an interface by bringing an ink-repellent processing liquid into contact with said plate from its ink jetting side and bringing a gas into contact with said plate from its ink inflow side, and after that forming an ink-repellent film on said plate.

According to the invention described in the structure (24), the jetting stability of ink droplets is improved, by boring a plurality of nozzles for jetting ink in a plate, carrying out a processing for making ink-familiar the plate provided with the nozzles, forming an interface by bringing an ink-repellent processing liquid into contact with said plate from its ink jetting side and bringing a gas into contact with said plate from its ink inflow side, and after that, forming an ink-repellent film on said plate.

(25) A method of manufacturing a nozzle plate comprising the steps of boring a plurality of nozzles for jetting ink in a plate, carrying out a processing for making ink-familiar the plate provided with said nozzles, forming an interface by bringing an ink-repellent processing liquid into contact with said plate from its ink jetting side and bringing a liquid which is different from said processing liquid into contact with said plate from its ink inflow side, and after that forming an ink-repellent film on said plate.

According to the invention described in the structure (25), the jetting stability of ink droplets is improved, by boring a plurality of nozzles for jetting ink in a plate, carrying out a processing for making ink-familiar the plate provided with the nozzles, forming an interface by bringing an ink-repellent processing liquid into contact with said plate from its ink jetting side and bringing a liquid which is different from said processing liquid into contact with said plate from its ink inflow side, and after that, forming an ink-repellent film on said plate.

(26) A method of manufacturing a nozzle plate as set forth in the structure (24) or (25), wherein the aforesaid boring of the nozzles is carried out by using a punch.

According to the invention described in the structure (26), the holes can be formed simply and with a high precision by using a punch.

(27) A nozzle plate having a plurality of nozzles for jetting ink, said nozzle plate being provided with an ink-repellent film at the ink jetting side of said nozzle plate and in the nozzles, the fluctuation of the entering length of said ink-repellent film into the nozzles being 1.0 μm or under among the nozzles.

According to the invention described in the structure (27), the variation of the amount of droplet fired from one nozzle to another can be suppressed to improve the jetting stability of ink droplets by it, that the nozzle plate is provided with an ink-repellent film on its one side and in the nozzles, and the fluctuation of the entering length of the ink-repellent film into the nozzles is made 1.0 μm or under among the nozzles. In this specification, the fluctuation of the entering length is expressed by the deviation, which is the difference between the entering length in each of the nozzles and the average of the values of the entering length over all the nozzles of the nozzle plate. Further, "the fluctuation of the entering length is 1.0 μm or under" means the state such that the deviation of the entering length in at least 95% of all the nozzles is 1.0 μm or under.

DETAILED DESCRIPTION OF THE PREFERRED EMBODIMENT

The present invention can be used with different types of ink jet ink. The terminology "ink-familiarity" and "ink-repellent" is used herein generically to refer to the ability of the ink to wet the surface or not wet the surface respectively. For example, when a water-based ink is to be used with the finished product, the term "ink-familiarity" refers to "hydrophilic" and the term "ink-repellent" refers to "hydrophobic" properties or substances. Similarly, if an oil-based ink is intended to be used with the finished product, the term "ink-familiarity" refers to "lipophilic" and the term "ink-repellent" refers to "lipophilic" properties or substances. Ink-familiar materials are ink-wettable materials.

In the following, embodiments of this invention will be explained in detail with reference to the drawings, but this invention should not be limited to these embodiments.

Figure 1:
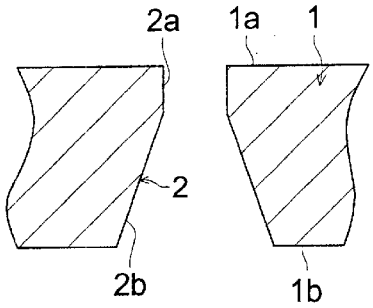
FIGS. 1(*a*) to 1(*g*) each is a drawing showing an example of ink-repellent processing for a nozzle plate of an ink jet head.
Figure 1:
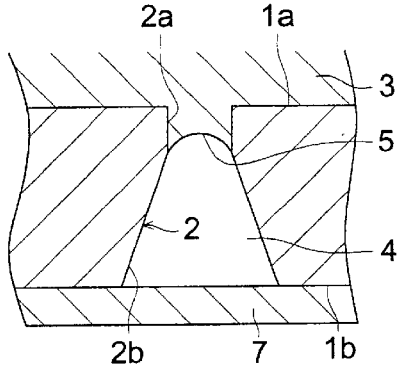
Figure 1:
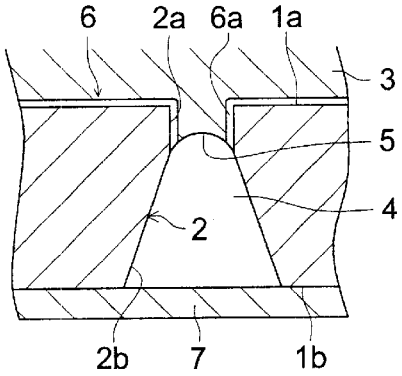
Figure 1:
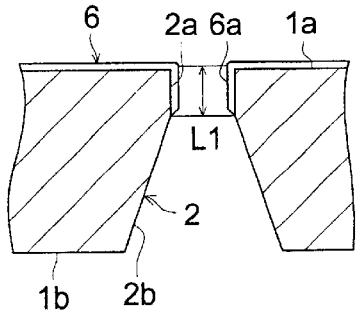
Figure 1:
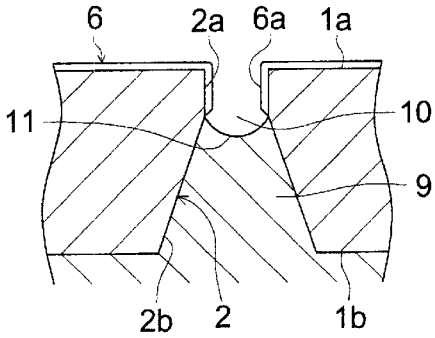
Figure 1:
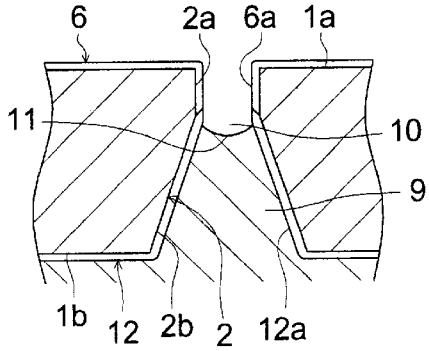
Figure 1:
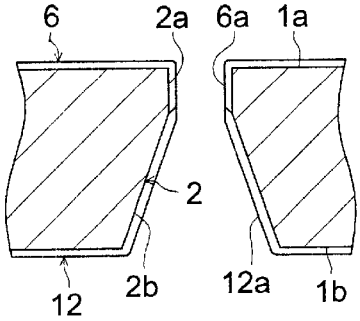

In FIG. 1(*a*), a nozzle plate of this embodiment is shown. For the material of the nozzle plate, metals, glasses, and resins can be cited; desirably, single component materials such as titanium, chromium, iron, cobalt, nickel, alloys such as nickel-phosphorous alloys, tin-copper-phosphorous alloys (phosphor bronzes), copper-zinc alloys, and stainless steel alloys, or resin materials such as polyimide, polycarbonate, polysulfone, ABS resin (acrylonitrile-butadiene-styrene copolymer), polyethyleneterephthalate, polyacetal, and various kinds of photosensitive resins can be cited.

This nozzle plate 1 has a plurality of nozzles 2 for jetting ink, and the nozzles 2 are bored, for example, by a precision punch. In another way, they may be bored by laser. Each of the nozzles 2 has a straight portion 2*a* formed at the ink jetting side and the funnel-shaped conical portion 2*b* formed with the larger opening positioned at the ink inflow side. 1*a* denotes the surface at the ink jetting side, and 1*b* denotes the surface at the ink inflow side.

In the case where the nozzle holes are bored by a punch, the nozzle holes are formed in a manner such that the shape of the punch is transferred as it is; therefore, this is desirable because the nozzle diameter and the inner nozzle volume can be made to be of the respective constant values for every nozzle, and high-precision nozzles can be formed.

In this nozzle plate 1, as shown in FIG. 1*b,* a closed pipe is formed by tightly closing the ink inflow side of the nozzle 2, for example, with the sealing member 7, and when the ink jetting side is brought into contact with the processing liquid 3, it enters into the nozzle 2 by capillary force. The interface 5 is formed between the processing liquid 3 and the gas 4 which exists in the nozzle 2, and this interface 5 stands still at the position where the capillary force balances with the pressure in the closed pipe. In this invention, for the gas used, one that is inactive to the processing liquid such as air, nitrogen, and oxygen may be used suitably, and in particular, air is desirable for its simplicity in handling.

For the processing liquid, a liquid including an ink-repellent substance or an ink-familiar substance may be suitably used. By this substance precipitating, a film is formed on the nozzle plate.

For the ink-repellent substance, PTFE (polytetrafluoroethylene), FEVE (copolymer of tetrafluoroethylene and vinylether), FEP (tetrafluoroethylene-hexafluoropropylene), ETFE (copolymer of tetrafluoroethylene and ethylene: copolymer of ethylene tetrafluoride and ethylene) etc. can be cited.

For the ink-familiar substance, water soluble high molecular substances such as polyacrylic acid, polyethylene imine, sulfonated polystyrene, a copolymer of maleic anhydride and styrene, and emulsions such as a copolymer of methylmethacrylate and acrylic acid can be used.

The processing liquid can be made by dispersing or solving one of the above-described ink-repellent substances or ink-familiar substances in a solvent.

For the above-described solvent, water, isopropyl alcohol, butylcellosolve, water soluble organic solvent et. can be cited.

For the method of forming the film, various kinds of methods such as electrodeposition, plating, and painting can be cited, and in particular, electrodeposition coating, electroplating, electroless plating are desirable.

For the processing liquid in the case of electrodeposition coating, an electrodeposition liquid composed of an acrylic resin having a carboxyl group which is neutralized by an amine and fine particles of PTFE dispersed in it is desirable, and for the processing liquid in the case of electroless plating, a nickel plating liquid including fine particles of PTFE is desirable.

The capillary pressure generated when a liquid having a surface tension $\delta$ and a contact angle $\theta$ with the tube wall of a capillary of radius r enters into the capillary is given by the expression $\Delta p=(2\delta/r)\cos\theta$. If a liquid enters into the capillary to raise the pressure in the closed tube by $\Delta p$, the pressure balances with the capillary pressure to stop the entering of the liquid. Accordingly, by keeping constant the nozzle diameter and the inner nozzle volume, the entering length can be kept constant. For the method of making constant the nozzle diameter and the inner nozzle volume, the method of boring holes with a punch is desirable. Further, the entering length of the processing liquid 3 varies depending on the physical property of the processing liquid. Therefore, in order to keep the entering length constant even though the physical property of the processing liquid 3 is varied, it is desirable to make a structure such that the pressure of the closed tube can be controlled.

The entering length of the film is the length from the surface of the nozzle plate to the position up to which the film enters into the nozzle, and for example, in FIG. 1, it is the entering amount L1 from the surface at the ink jetting side 1*a*. Further, in the case where a film is made to enter into the nozzle from the surface at the ink inflow side 1*b,* it means the entering amount from the surface at the ink inflow side 1*b*.

After that, as shown in FIG. 1(*c*), the film 6 based on the processing liquid 3 is formed on the nozzle plate 1. This film 6 can be easily formed by electrodeposition coating or electroplating. For example, the nozzle plate is dipped in a electrodeposition paint, and the position of the interface is determined by controlling the pressure; then, when a direct electric current is made to flow between the nozzle plate and the counter electrode, the film 6 of the electrodeposition paint is formed on the nozzle plate 1.

The electrodeposition coating is carried out by dipping the nozzle plate in an electrodeposition liquid composed of, for example, an acrylic resin neutralized by an amine and fine particles of PTFE (polytetrafluoroethylene) dispersed in it, and applying a direct current voltage of 30 to 60 V for 30 to 60 seconds, to form an ink-repellent film of several $\mu$m as the result. This film can also be formed by plating. As for the plating processing, there are electroplating and electroless plating, and plating is carried out by dipping the nozzle plate in a nickel plating liquid including fine particles of PTFE (polytetrafluoroethylene).

As shown in FIG. 1(*d*), this film 6 formed on the nozzle plate 1 enters into the nozzle 2 from the surface at the ink jetting side 1*a*. The control of the entering length L1 of this entering portion 6*a* is carried out by controlling the position of the interface formed by the processing liquid 3 and the gas 4.

In this way, the entering length can be controlled in accordance with the position of the interface 5 by controlling the pressure of the gas 4 in the nozzle 2 of the nozzle plate 1. Owing to this, the jetting stability of ink droplets is improved and mass production at a low cost is possible.

This film formed 6 is an ink-repellent film. Not only by the processing for making ink-repellent the surface at the ink jetting side la of the nozzle plate 1, but also by the processing for making ink-repellent the entering portion 6*a* into the nozzle 2 for a certain length, the nozzle plate 1 is difficult to be smudged, and the jetting of ink droplets is stabilized.

After the formation of this ink-repellent film, as shown in FIG. 1(*f*), the film 12 based on the processing liquid 9 is formed on the nozzle plate 1. This film 12 can be easily formed by electrodeposition coating in the same way as the film 6. For example, by dipping the nozzle plate 1 in an elecrodeposition paint and making a direct electric current flow between the nozzle plate and the counter electrode, a film of the electrodeposition paint is formed on the nozzle plate 1. This film 12 can also be formed by electroplating processing.

This film 12 formed on the nozzle plate 1 precipitates on the portion which is not covered by the ink-repellent film 6. As shown in FIG. 1(*g*), because the portion covered by the ink-repellent film 6 has no electrical conductivity, the electrodeposition or electroplating film does not precipitate on it. In this embodiment, the film formed 12 is an ink-familiar film.

Moreover, the film 12 is an ink-familiar film, and it makes ink-familiar not only the surface at the ink inflow side 1*b* of the nozzle plate 1, but also the entering portion 12*a* of the nozzle 2 for a certain length; therefore, ink becomes easy to enter into the nozzle 2 from the ink inflow side, and the jetting of ink droplets is stabilized.

Besides, in this embodiment, the ink-familiar film is formed not only on the surface at the ink inflow side 1*b* of the nozzle plate but also on the entering portion 12*a* in the nozzle 2; however, because whole surface of the nozzle plate is made ink-familiar at first, it is not necessary to form an ink-familiar film. If an ink-familiar film is formed, ink becomes easy to enter into the nozzle and the jetting of ink droplets is more stabilized.

As shown in FIG. 1, in the case where the nozzle 2 of the nozzle plate 1 is tightly closed with the sealing member 7 such as a film sheet in a simple way, the position of the interface is determined by the inner volume of the nozzle 2. That is, the position of the interface 5 is constant for every nozzle 2.

However, according to a method of tightly closing each of the nozzles separately one by one, if there is a nozzle which is imperfectly closed, the entering length into that nozzle becomes longer. Further, when the film pieces composing the sealing member are peeled off, if some pieces are left on the nozzles, image quality deteriorates to a large extent. For this reason, it is better that the tight closing is done by covering the whole rear surface of the nozzle plate with a single sheet.

As in this embodiment, if an ink-familiar film is formed by electrodeposition coating after the formation of an ink-repellent film by electrodeposition coating, the area of the ink-repellent film and that of the ink-familiar film can be precisely made separate, because the ink-familiar film does not precipitate on the ink-repellent film.

Further, it is also appropriate to carry out a processing for making ink-familiar whole surface of the nozzle plate before the formation of an ink-repellent film. If this is done, the adhesion of the ink-repellent film is made better, and air bubbles do not attach at the ink inflow side of the nozzle; thus, ink becomes easy to enter into the nozzle holes and the jetting of ink droplets is much more stabilized.

For the ink-familiar processing, alkali electrolytic cleaning is desirable in the processing for making ink-familiar whole surface of a stainless steel nozzle plate. The nozzle plate is dipped in a cleaning liquid including sodium hydroxide, a surfactant, and a silicate, and a direct electric current is made to flow for five minutes at a condition of 2 to 4 V and 15 A/dm$^2$. After rinsing and drying, the processing for making ink-repellent is done by closing the ink inflow side of the nozzle plate and dipping the plate in the ink-repellent electrodeposition liquid.

Figure 2:
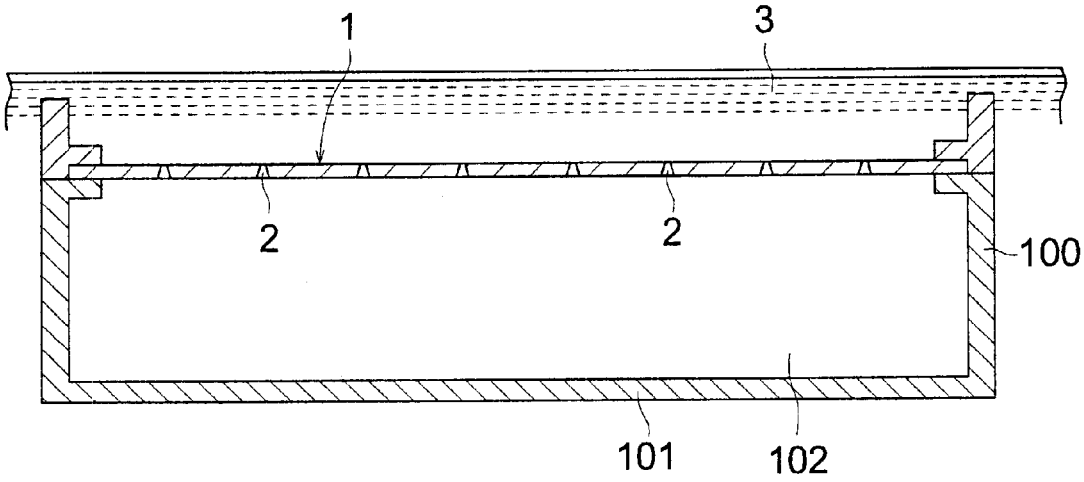
FIG. 2 is a drawing showing another example of ink-repellent processing for a nozzle plate of an ink jet head.

FIG. 2 shows another embodiment of this invention. It is a method such that the nozzle plate 1 is held in the case 100 and whole rear surface of the nozzle plate 1 is tightly closed, not closing each of the nozzle holes separately one by one. Because a resin material or a film is not in contact with the nozzle holes 2, there is no possibility of these being residual. Further, the pressure of the gas 102 in the tightly closed portion 101 can be finely controlled, and the entering length of the processing liquid into the nozzles 2 can be freely controlled.

Figure 3:
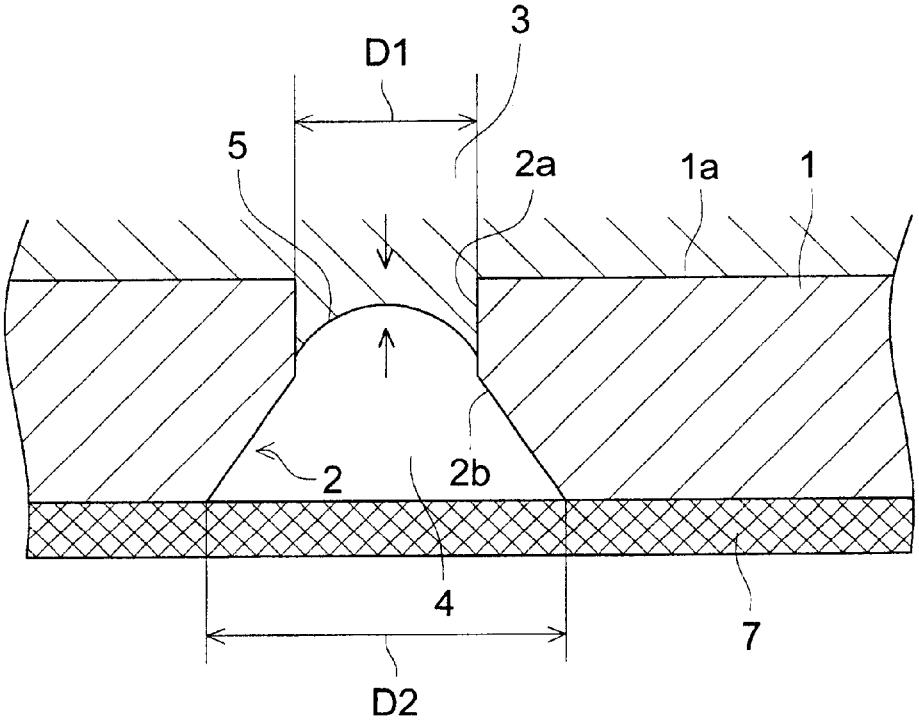
FIG. 3 is a drawing for illustrating the entering length of an ink-repellent film formed in a nozzle.
Figure 5:
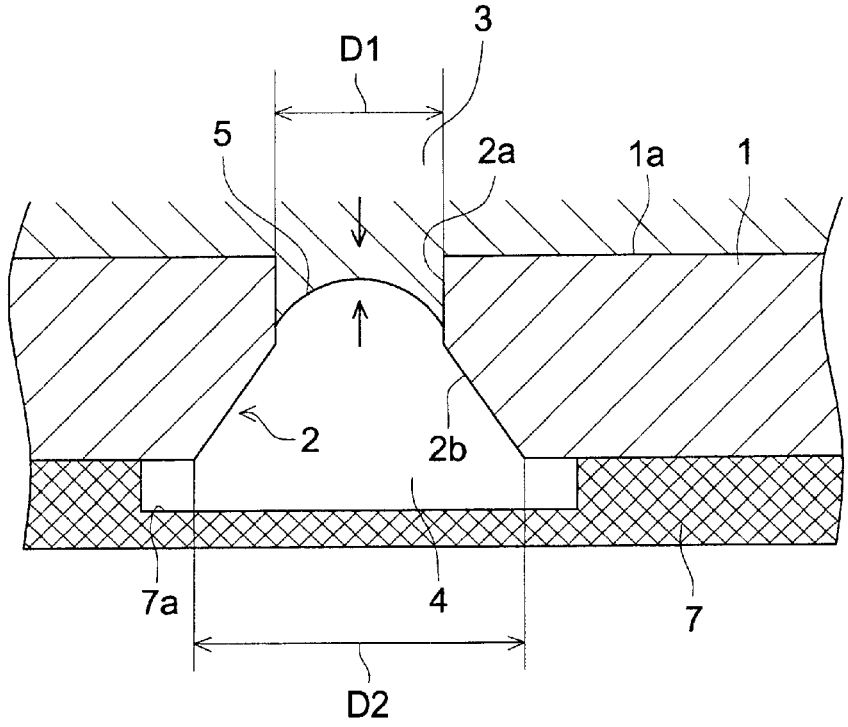
FIG. 5 is a drawing of another embodiment for enlarging the entering length of an ink-repellent film formed in a nozzle.

Further, with respect to the changeover of the position of the interface 5, in the embodiment shown in FIG. 3, the diameter of the straight portion 2*a* of the nozzle 2 is determined to be D1, and the maximum diameter of the conical portion 2*b* is determined to be D2, to make it small the length of the portion from the surface at the ink jetting side 1*a* to the position of the interface 5, which is formed by the processing liquid 3 and the gas 4, entering into the nozzle 2; however, in the embodiment shown in FIG. 5, by determining the maximum diameter of the conical portion 2*b* is D3 to be larger than the diameter D2 in FIG. 3, the volume of the gas 4 is made larger to lower the pressure, and it is possible to make it larger the length from the surface at the ink jetting side 1*a* to the interface 5 entering into the nozzle 2.

In the embodiment shown in FIG. 5, concave portions 7*a* are formed in the sealing member 7 at the positions corresponding to the nozzles 2, and owing to this concave portions 7*a,* which is determined to be larger than the diameter D2 shown in FIG. 3, the volume of the gas 4 is made larger to lower the pressure, which makes larger the length from the surface at the ink jetting side 1*a* to the interface 5 entering into the nozzle 2.

Figure 6:
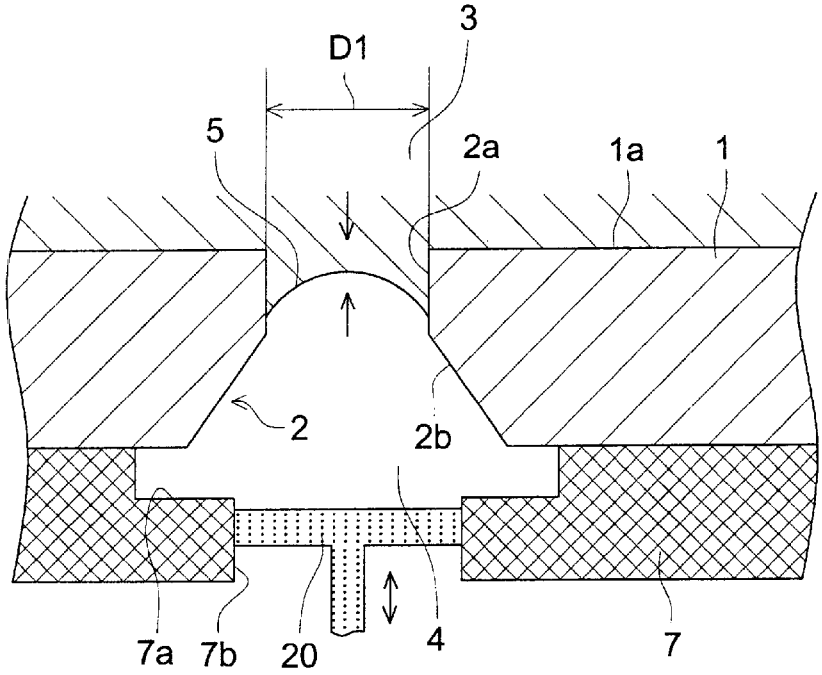
FIG. 6 is a drawing showing an example capable of varying the entering length of an ink-repellent film formed in a nozzle.

In the embodiment shown in FIG. 6, concave portions 7*a* are formed in the sealing member 7 at the positions corresponding to the nozzles 2, and the piston 20 is provided in each of the control holes 7*b* which conduct to the concave portions respectively, to make the volume of the gas 4 be varied. Because the pressure is varied by varying the volume of this gas 4, it can be varied the length from the surface at the ink jetting side 1*a* to the position of the interface 5 entering into the nozzle 2.

Figure 4:
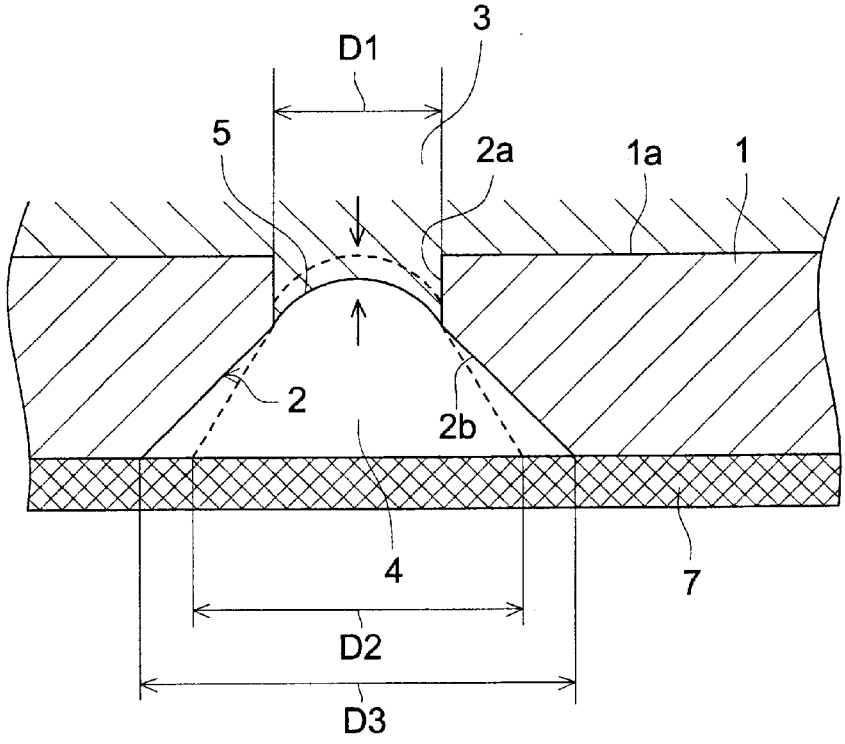
FIG. 4 is a drawing for illustrating the method of enlarging the entering length of an ink-repellent film formed in a nozzle.
Figure 7:
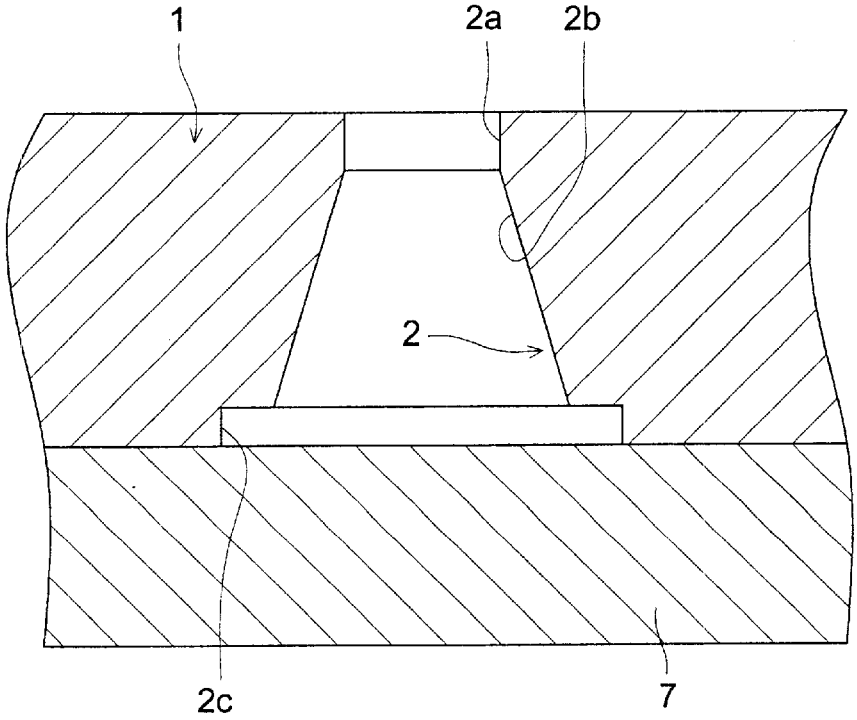
FIG. 7 is a drawing showing an embodiment in which a step portion is formed in the conical portion of a nozzle.
Figure 8:
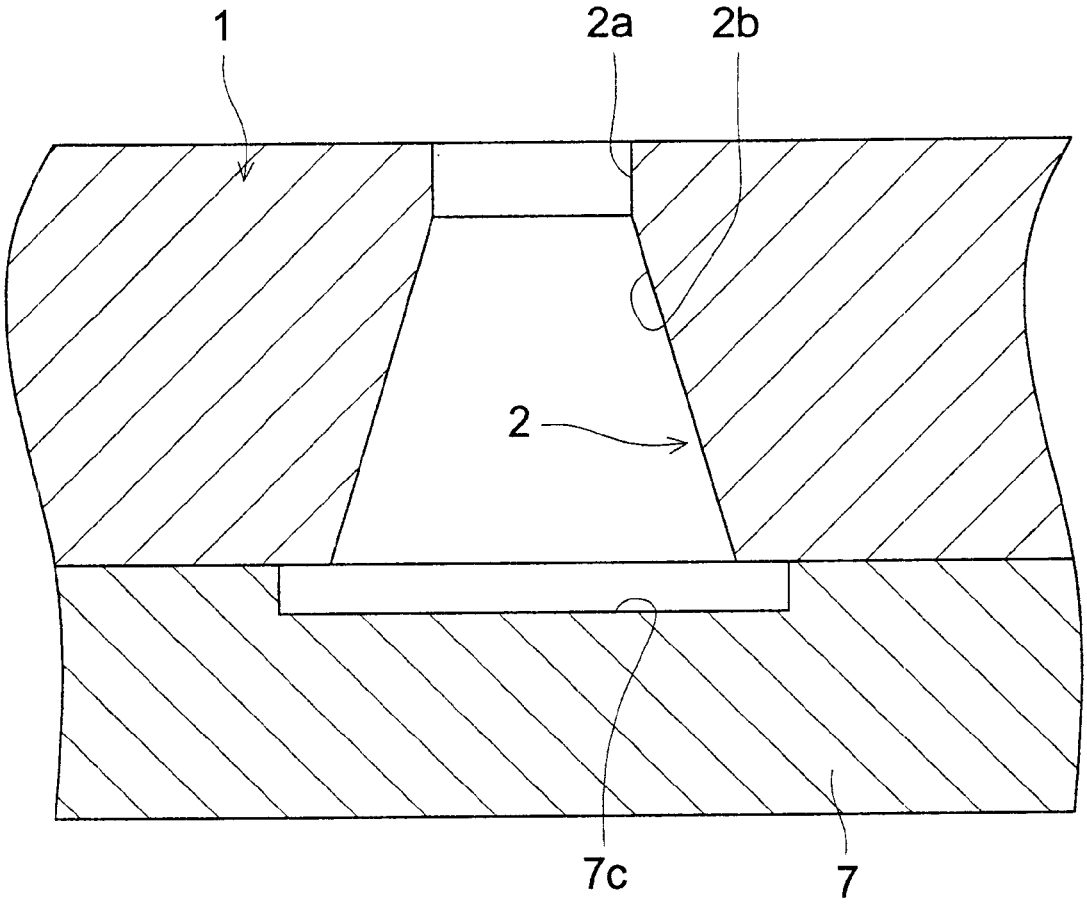
FIG. 8 a drawing showing an embodiment in which a concave portion is formed in a sealing member.

The nozzle plates of the embodiments shown in FIG. 7 and FIG. 8 are ones such that volume of the nozzle is made large in a similar way to those shown in FIG. 4 and FIG. 5; in the embodiment shown in FIG. 7, a step portion 2*c* having a shape of spot facing is formed at the ink inflow side of each of the funnel-shaped conical portions 2*b,* and in the embodiment shown in FIG. 8, shallow concave portions 7*c* are formed in the sealing member 7 at the positions corresponding to the conical portions 2*b;* both of these have a structure capable of easily varying the entering length into the nozzle 2.

Figure 9:
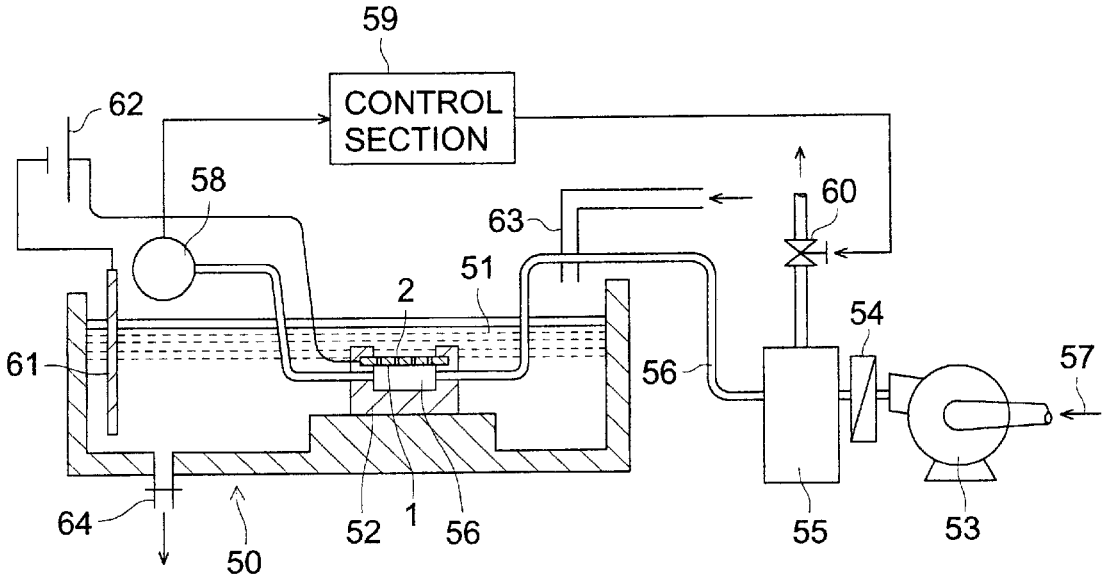
FIG. 9 is a drawing showing the overall structure of a manufacturing apparatus of nozzle plates.
Figure 10:
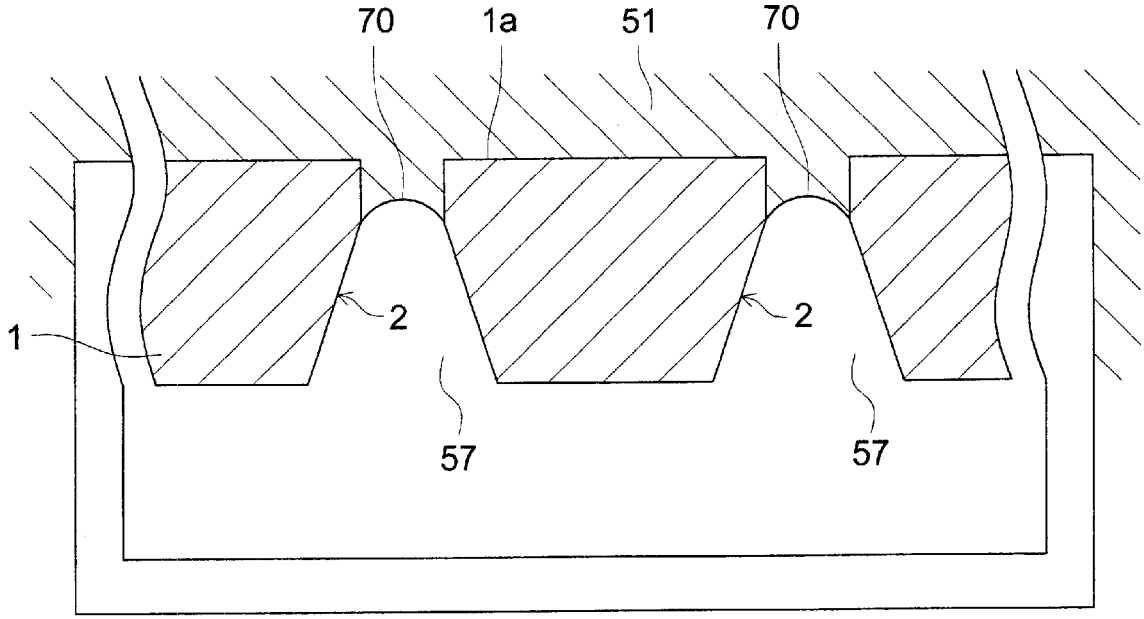
FIG. 10 is an enlarged cross-sectional view of the holder in a manufacturing apparatus of nozzle-plates.

FIG. 9 and FIG. 10 shows manufacturing apparatus of nozzle plates of ink jet heads of this invention; FIG. 9 shows the overall structure of the manufacturing apparatus of nozzle plates, and FIG. 10 is an enlarged cross-sectional view of the holder of a nozzle plate.

In the electrodeposition coating tank 50, there are provided the inlet pipe 63 for letting the electrodeposition liquid 51 flow in and the outlet opening 64 for exhausting the electrodeposition liquid 51. First, the holder 52, which is holding a nozzle plate, is placed horizontally in the electrodeposition coating tank 50. Into the holder 52, the air 57 is supplied by the driving of the fan 53 through the filter 54, pressure control room 55, and the air supply pipe 56.

The pressure gauge 58 is connected to the inside of the holder 52 to measure the pressure in the holder 52, and the control means 59 controls the pressure adjusting valve 60 on the basis of this pressure information, to adjust the pressure of the air in the holder 52. After that, the electrodeposition liquid 51 is supplied from the inlet pipe 63, and the nozzle plate 1 and the holder 52 are dipped in the electrodeposition liquid 51. At that time, as shown in FIG. 10, by the pressure adjustment of the gas in the holder 52, the electrodeposition liquid 51 is brought into contact with the nozzle plate having a plurality of nozzles 2 from the ink jetting side of the nozzles 2, and the air 57 is brought into contact with the-nozzle plate from the ink inflow side, to form the interface 70 in the plural nozzles 2 by the electrodeposition liquid 51 and the air 57.

The electrode 61 is disposed in the electrodeposition liquid 51 in the electrodeposition coating tank 50, and an electric voltage is applied between this electrode 61 and the nozzle plate 1 from the electric source 62; thus, not only the surface at the ink jetting side 1*a* but also the entering portion in the nozzles 2 for a certain length can be processed to become ink-repellent.

Further, it is also appropriate that, in the electrodeposition coating tank 50, the electrodeposition liquid 51 is stored beforehand, and the holder 52 holding the nozzle plate 1 is dipped in this electrodeposition liquid 51.

Figure 11:
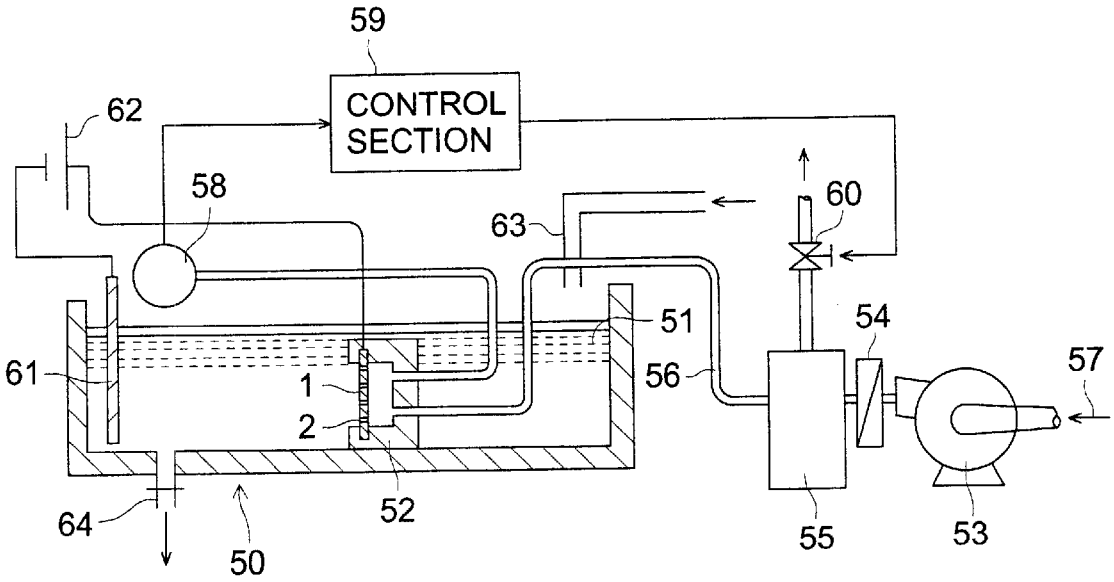
FIG. 11 is a drawing showing the overall structure of another embodiment of manufacturing apparatus.

FIG. 11 shows another embodiment, in which the nozzle plate 1 to be coated by electrbdeposition is disposed to be parallel to the electrode 61. This is desirable because, by carrying out the electrodeposition coating with the nozzle plate arranged in this manner, an electrodeposition film having a uniform thickness over the whole surface of the nozzle plate 1 is formed.

Further, according to this invention, the nozzles 2 for jetting ink are bored in the nozzle plate 1, a processing for making ink-familiar whole surface of the nozzle plate 1 provided with the nozzles 2 is carried out, an interface is formed by bringing an ink-repellent processing liquid into contact with the nozzle plate 1 from its ink jetting side and bringing air into contact with the plate from its ink inflow side, and after that an ink-repellent film can be formed on the nozzle plate 1.

Further, the deviation of the entering length into the nozzles 2 of every ink-repellent film formed in the nozzles 2 can be made 1.0 $\mu$m or under, to improve the jetting stability of ink droplets, using the interfaces which are formed by bring the processing liquid into contact with the nozzle plate 1 from one side of the nozzles 2, and bringing air into contact with the plate from the other side. In this specification, the fluctuation of the entering length is expressed by the deviation, which is the difference between the entering length in each of the nozzles and the average of the values of the entering length over all the nozzles of the nozzle plate. Further, "the fluctuation of the entering length is 1.0 $\mu$m or under" means the state such that the deviation of the entering length in at least 95% of all the nozzles is 1.0 $\mu$m or under.

Up to now, examples utilizing the interface formed by the processing liquid 3 and air have been shown, but the case where the interface formed by the processing liquid 3 and a liquid which is different from this is utilized is similar to them. For the liquid, any liquid is suitable so long as it can form an interface without being mixed with the processing liquid 3; for example, mercury is appropriate, and in the case where the processing liquid 3 is a liquid based on water, an oily-natured liquid can be used.

The case where a gas is used is more desirable because an excellent effect that the film can be produced and controlled with a simpler structure is obtained.

(Example of Practice)

The method of this invention in which the film is formed by forming an interface using air was compared with the conventional method in which the film is formed by filling the nozzle with a resin.

300 nozzle holes having the diameter of the outlet portion of the nozzle holes of 42 $\mu$m, the length of their straight portion of 20 $\mu$m, and the diameter of the inlet portion of the nozzles of 90 $\mu$m are bored with a precision punch, in a plate made of SUS304 with a thickness of 100 $\mu$m with an interval of 180 DPI. Let these bored nozzle holes be the nozzle No. 1 to the nozzle No. 300 consecutively.

This nozzle plate is fitted in the apparatus of this invention shown in FIG. 9, the pressure is adjusted to keep the pressure inside the holder 52 higher than the atmospheric pressure by $2.57\times10^3$ Pa (about 2.6% of the atmospheric pressure), and the plate was coated with an electrodeposition liquid composed of an acrylic resin including fine particles of fluorine-contained resin dispersed in it.

As an comparison example, the above-described nozzle plate was laminated with a photosensitive dry film DIARON FRA305-38 manufactured by Mitsubishi Rayon Inc. to the ink supplying side of the plate at 4 kgf/cm$^2$ and 60° C. by a laminator. Next, it was irradiated by an ultraviolet ray having an intensity of 750 mJ/cm$^2$.

This nozzle plate was dipped in a nickel plating liquid in which fine particles of fluorine-contained resin is dispersed, and the surface of the nozzle plate and the outlet portion of the nozzle holes were plated for ink-repelling. The plate was dipped in a photosensitive resin removing liquid, to solve the resin inside the nozzles.

The entering length of the ink-repellent portion was measured by taking photographs of the nozzle outlet portions with the samples tilted by 30° and 45° using a scanning electronic microscope; the entering length was calculated from the following expression:

$$H=(p/\sin\theta)-(p'/\sin\theta),\ \theta 45°-30°,$$

where p is the entering length in the photographed image taken with the sample tilted by 30°, and P' is the entering length in the photographed image taken with the sample tilted by 45°.

In the following, the values of the entering length for the nozzle No.1, 50, 100, 150, 200, 250, and 300 are shown as examples.

| | Entering length | |
|---|---|---|
| Nozzle No. | Resin-filled method | Air-filled method |
| 1 | 6.0 $\mu$m | 7.0 $\mu$m |
| 50 | 8.5 | 7.5 |
| 100 | 5.5 | 6.8 |
| 150 | 13.4 | 7.0 |
| 200 | 15.6 | 7.3 |
| 250 | 6.0 | 6.3 |
| 300 | 12.3 | 7.2 |

The average value of the entering length according to the resin-filled method over all nozzles is 10.1 $\mu$m, and the deviation of the 95% of the nozzles, namely 285 nozzles, was 6.2 μm. On the other hand, the average value of the entering length according to the method of this invention using air over all nozzels was 7.2 μm, and the deviation of the 95% of the nozzels, namely 285 nozzles, was 0.8 μm, which is smaller than 1.0 μm.

From the foregoing, it has been found that the variation of the entering length from one nozzle to another is smaller in comparison with the resin-filled method.

As described up to now, this invention has an excellent effect that, by utilizing the interface between the processing liquid or producing a film and a gas or a liquid which is different from the processing liquid, it is possible to control the entering length of the processing liquid, that is, the length of the film formed on the nozzle plate entering into the inside of the nozzle holes freely, easily, and with high precision.

Further, by making the fluctuation in an entering length of the ink repellency film layer in each of the plurality of nozzel holes to be not larger than 1.0 μm, a flying direction of an ink droplet jetted from each nozzle hole is stabilized, and the surface of the nozzle plate is hardly stained.

What is claimed is:

1. A method of forming a layer of film in a plurality of nozzle holes for jetting ink, wherein each nozzle hole of the plurality of nozzle holes passes through a nozzle plate, comprising the steps of:

attaching an enclosing member to one side of the nozzle plate in such a way that an enclosed gas space is formed at one end of each nozzle hole and gas in the enclosed gas space is vented only through the other end of each nozzle hole; thereafter bringing the other side of the nozzle plate in contact with a processing liquid so as to allow the processing liquid to enter in each nozzle hole with a capillary action of the processing liquid so that a boundary surface between the processing liquid and the gas in the enclosed gas space is formed at a position in each nozzle hole where the pressure of the gas and the force of the capillary action of the processing liquid are balanced; and thereafter, forming a layer of film corresponding to the processing liquid while keeping the position of the boundary surface so that the layer of film is formed in each nozzle hole in accordance with the position of the boundary surface.

2. The method of claim 1, wherein by controlling a position of the boundary surface in each of the plurality of nozzle holes, an entering length of the film layer entering into each of the plurality of nozzle holes is controlled.

3. The method of claim 1, wherein by controlling gas pressure of the gas, the position of the boundary surface is controlled.

4. The method of claim 1, wherein the formed film layer is an ink-repellency film layer.

5. The method of claim 4, wherein after forming the ink repellency film layer, a process to provide a ink-familiarity to the nozzle plate is conducted.

6. The method of claim 4, wherein before forming the ink repellency film layer, a process to provide a ink-familiarity to the nozzle plate is conducted.

7. The method of claim 4, wherein the entering length of the ink repellency film layer in each of the plurality of nozzle holes not smaller than 5 μm and not larger than 10 μm.

8. The method of claim 4, wherein fluctuation in the entering length among the plurality of nozzle holes is not larger than 1.0 μm.

9. The method of claim 1, wherein the formed film layer is an ink-familiar film layer.

10. The method of claim 9, wherein after forming the ink-familiar film layer, an ink repellency film layer is formed.

11. The method of claim 1, wherein the enclosing is conducted at an ink inflow side of the nozzle plate.

12. The method of claim 1, wherein the film layer is formed by an electrodepositing process.

13. The method of claim 1, wherein the film layer is formed by a plating process.

14. The method of claim 1, wherein the nozzle plate is made of a metal.

15. The method of claim 1, wherein the nozzle plate is made of a resin.

16. The method of claim 15, wherein the nozzle plate is provided with a metal layer on a surface thereof.

17. The method of claim 1, further comprising:

controlling the position of the boundary surface in each nozzle hole by adjusting the pressure of the gas with a pressure regulator connected through the enclosing member to the enclosed gas space.

18. The method of claim 17, wherein the controlling step controls the position of the boundary surface in such a way that the dispersion in an entering length of the layer of film among nozzle holes of 95% of all nozzle holes is 1.0 μm or less.

19. The method of claim 1, wherein the enclosing member is a plate to cover the one side of the nozzle plate.

20. The method of claim 1, wherein the enclosing member is a box to enclose the one side of the nozzle plate.

21. The method of claim 1, wherein in the step of bringing the nozzle plate in contact with the processing liquid, the nozzle plate attached with the enclosing member is immersed in the processing solution.

22. The method of claim 21, wherein the nozzle plate attached with the enclosing member is placed horizontally in the processing solution.

23. The method of claim 21, wherein the nozzle plate attached to the enclosing member is placed vertically in the processing solution.

* * * * *